US008336860B1

(12) United States Patent
Powell et al.

(10) Patent No.: US 8,336,860 B1
(45) Date of Patent: Dec. 25, 2012

(54) METHOD AND APPARATUS FOR GRIPPING CHAIN

(76) Inventors: Paul B. Powell, Castleberry, AL (US); Paul L. Stephens, Oneonta, AL (US)

( * ) Notice: Subject to any disclaimer, the term of this patent is extended or adjusted under 35 U.S.C. 154(b) by 616 days.

(21) Appl. No.: 12/587,984

(22) Filed: Oct. 16, 2009

(51) Int. Cl.
*B21F 9/00* (2006.01)
*B66F 3/00* (2006.01)

(52) U.S. Cl. ..... 254/243; 254/256; 81/15.8; 81/177.5

(58) Field of Classification Search ..... 254/243, 254/250, 256, 257; 81/15.8, 177.5
See application file for complete search history.

(56) References Cited

U.S. PATENT DOCUMENTS

| | | | | | |
|---|---|---|---|---|---|
| 864,652 | A | | 8/1907 | King | |
| 1,179,951 | A | | 4/1916 | Moore | |
| 1,889,633 | A | * | 11/1932 | Butterworth | 24/116 R |
| 3,282,045 | A | * | 11/1966 | Thelan | 59/93 |
| 3,521,443 | A | | 7/1970 | Dragonuk | |
| 3,729,926 | A | | 5/1973 | Buske | |
| 4,241,575 | A | | 12/1980 | St. Germain | |
| 4,269,249 | A | * | 5/1981 | McLean | 152/213 A |
| 4,416,319 | A | * | 11/1983 | Hofmann | 152/213 R |
| 5,048,376 | A | * | 9/1991 | Faanes | 81/15.8 |
| 5,309,706 | A | | 5/1994 | Lasaroff et al. | |
| 6,003,236 | A | * | 12/1999 | Hoeft | 33/533 |
| 6,089,130 | A | * | 7/2000 | Wu | 81/170 |
| 6,568,165 | B2 | * | 5/2003 | Smetz | 59/93 |
| 6,619,623 | B1 | | 9/2003 | Kobelt | |
| 6,899,001 | B1 | * | 5/2005 | Sanders et al. | 81/176.3 |
| 7,051,390 | B2 | * | 5/2006 | van Beek | 7/145 |
| 7,269,937 | B2 | * | 9/2007 | Fredriksson | 59/93 |
| 7,823,942 | B1 | * | 11/2010 | McCraw et al. | 294/82.1 |
| 2002/0119849 | A1 | | 8/2002 | Maynard | |

* cited by examiner

*Primary Examiner* — Emmanuel M Marcelo
(74) *Attorney, Agent, or Firm* — George L Williamson

(57) ABSTRACT

A method and apparatus for a hand tool useful for gripping a chain or chain portion of a chain hoist. The tool comprises a shaft having a handle portion on one end and a body or ring portion on the other end which ring has an slot or cut-through therein through which a chain can be inserted into a central hole or opening of the ring; furthermore, an indention is provided in the ring wherein a link of a chain is captured in the indention thereby allowing the user to pull on the handle so as to move the chain a given distance. Thereafter, the chain is removed from the indention, repositioned in the center hole and the tool repositioned to a different link of the chain wherein the succeeding link is captured in the indention and the chain is again pulled another distance. By repeating this process, the chain can be pulled a great distance in a much easier manner than is currently available.

16 Claims, 3 Drawing Sheets

METHOD AND APPARATUS FOR GRIPPING CHAIN

BACKGROUND OF THE INVENTION

1. Field of the Invention

The present invention relates generally to hand tools and, more particularly, is concerned with a method and apparatus for a hand tool for gripping a chain.

2. Description of the Prior Art

Tools for gripping chains have been described in the prior art, however, none of the prior art devices disclose the unique features of the present invention.

In U.S. Pat. No. 3,729,926 dated May 1, 1973, Buske disclosed a claw hook for chains. In U.S. Pat. No. 864,652 dated Aug. 27, 1907, King disclosed a coupling device. In U.S. Pat. No. 4,241,575 dated Dec. 30, 1980, St. Germain disclosed a chain saddle assembly. In U.S. Pat. No. 5,309,706 dated May 10, 1994, Lasaroff, et al., disclosed a shackle type connector. In U.S. Pat. No. 1,179,951 dated Apr. 18, 1916, Moore disclosed a chain gripping device. In U.S. Pat. No. 6,619,623 dated Sep. 16, 2003, Kobelt disclosed a chain pulling device. In U.S. Pat. No. 3,521,443 dated Jul. 21, 1970, Dragonuk disclosed a hook for cargo tie-down. In U.S. Patent Application Publication No. 2002/0119849 dated Aug. 29, 2002, Maynard disclosed a bicycle chain manipulation tool. While these tools for gripping chains may be suitable for the purposes for which they were designed, they would not be as suitable for the purposes of the present invention as hereinafter described.

SUMMARY OF THE PRESENT INVENTION

The present invention discloses a method and apparatus for a hand tool useful for gripping a chain or chain portion of a chain hoist. The tool comprises a shaft having a handle portion on one end and a body or ring portion on the other end which ring has an slot or cut-through therein through which a chain can be inserted into a central hole or opening of the ring; furthermore, an indention is provided in the ring wherein a link of a chain is captured in the indention thereby allowing the user to pull on the handle so as to move the chain a given distance. Thereafter, the chain is removed from the indention, repositioned in the center hole and the tool repositioned to a different link of the chain wherein the succeeding link is captured in the indention and the chain is again pulled another distance. By repeating this process, the chain can be pulled a great distance in a much easier manner than is currently available.

An object of the present invention is to provide a hand tool which can be used to grip and pull a chain. A further object of the present invention is to provide a tool which can pull a chain portion of a chain hoist assembly. A further object of the present invention is to provide a tool which can be relatively easily used by a user. A further object of the present invention is to provide a tool which can be relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
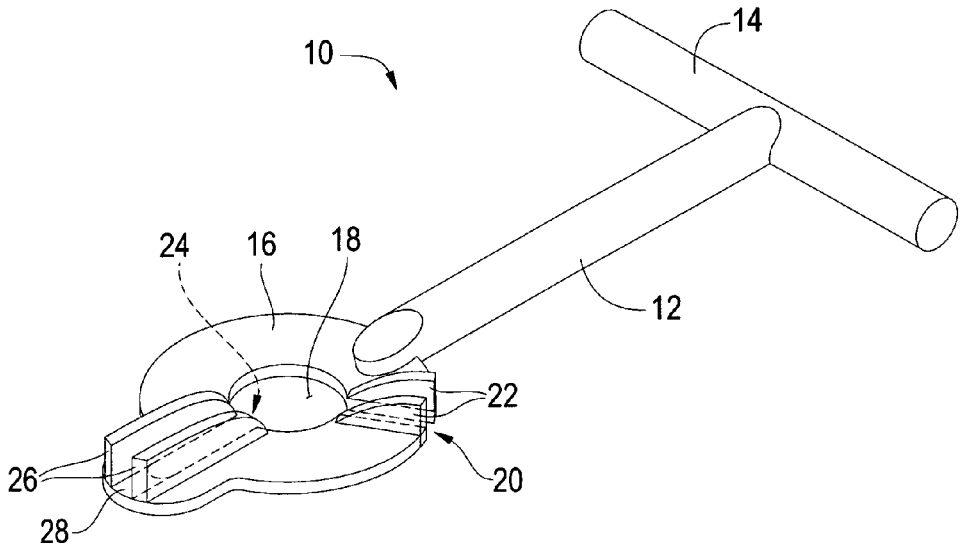
FIG. 1 is a perspective view of the present invention.

With regard to reference numerals used, the following numbering is used throughout the drawings.

10 present invention
12 shaft
14 handle
16 body
18 hole
20 slot
22 pair of protrusions
24 indention
26 pair of protrusions
28 uncut portions
30 chain
32 chain link
34 chain hoist
36 chain portion of the hoist
38 block portion of the hoist
40 direction arrow

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a method and apparatus for gripping a chain is disclosed.

Figure 2:
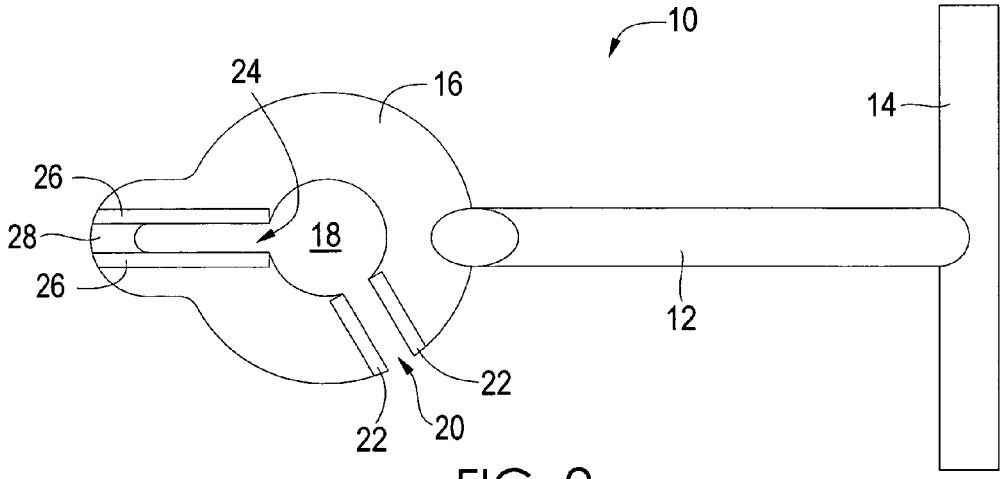
FIG. 2 is a plan view of the present invention.

Turning to FIGS. 1 through 2, therein is shown the present invention 10 having a shaft 12 and a "T" shaped handle 14 on one end and a ring-shaped body 16 on the other end. Body 16 has a hole or opening 18 in the center thereof along with a first inlet/outlet slot or cut-through 20 having first and second upwardly extending protrusions 22 on each side along with a second indention or partial slot 24 having first and second upwardly extending protrusions 26 on each side along with a portion 28 which is uncut which together form a receptacle. The length of cut-through 20 is about the same as the width of a link of chain whereas the length of slot 24 is longer than the width of a link of chain. Ring 16 may be flattened. Also, indention 26 forms an offset portion in ring 16. Cut-through 20 and protrusions 22 are effectively sized to allow a chain to pass therethrough. Indention 24 and protrusions 26 are effectively sized to capture a chain link therein.

Figure 3:
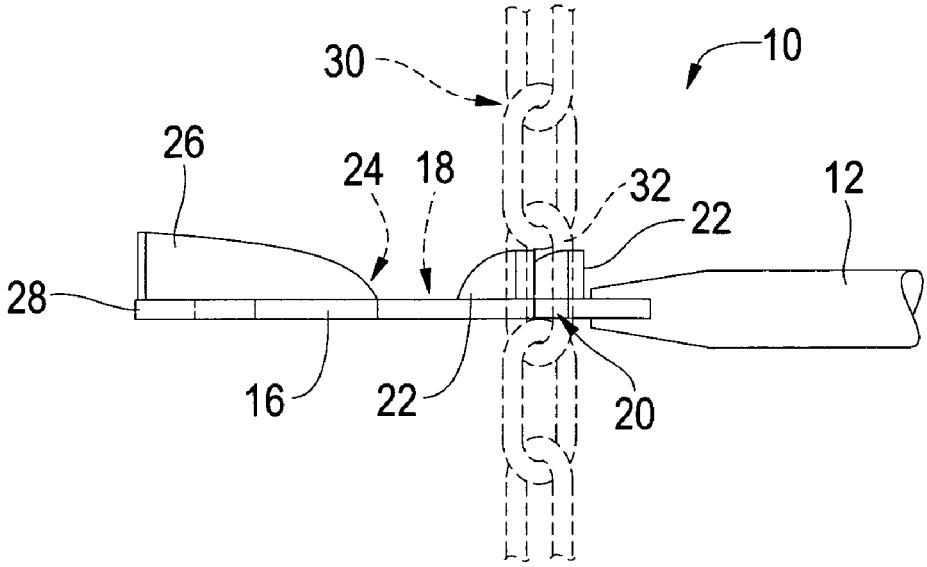
FIG. 3 is a side elevation view of the present invention shown in operative connection with a chain.
Figure 4:
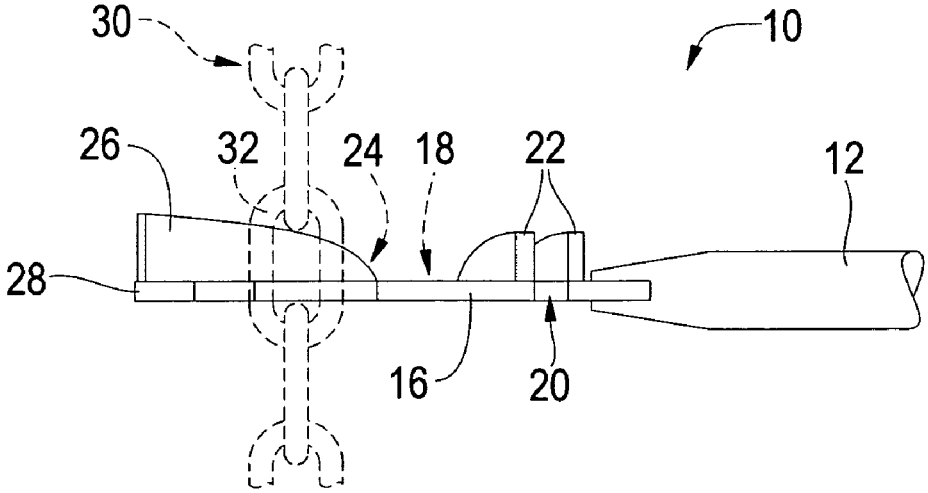
FIG. 4 is a side view of the present invention shown in operative connection with a chain.

Turning to FIGS. 3 and 4, therein is shown the present invention 10 having a shaft 12 and a handle 14 (not shown, see FIG. 1) on one end and a ring 16 on the other end. Ring 16 has a hole 18 in the center thereof along with a first inlet/outlet slot or cut-through 20 having first and second upwardly extending protrusions 22 on each side along with a second indention 24 having first and second upwardly extending protrusions 26 on each side along with a portion 28 which is uncut. The length of cut-through 20 is about the same as the width of a link 32 of conventional chain 30 whereas the length of indention 24 is longer than the width of link 32. Cut-through 20 and protrusions 22 are effectively sized to allow link 32 of chain 30 to pass therethrough. In FIG. 3, it can be seen that at the highest point, the height of protrusions 22 is slightly less than the distance between succeeding links 32 of chain 30 being effectively sized to allow a link 32 of chain 30 to pass through slot 20. In FIG. 4, it can be seen that at the highest point, the height of protrusions 26 is slightly greater than the distance between links 32 of chain 30 and is effectively sized to capture the link 32 of chain 30 therein by the chain becoming wedged or bound as succeeding links 32 of chain 30 engage the upper edge of the protrusions 26 and the bottom of body 16 as seen in FIG. 4. Both slot 20 and indention 24 are slightly wider than a ¼ inch diameter link of chain being approximately 5/16 inch in width so that the chain 30 will pass therethrough. In operation, a chain link 32 can be inserted through slot 20 into a central hole 18 of the ring 16, then, the chain link is moved from the hole into indention 24 so that the link of the chain is captured in indention 24 thereby allowing the user to pull on the handle so as to move the chain 30 a given distance. Thereafter, the chain link 32 is removed from indention 24 and repositioned in the center hole 18 and the tool 10 repositioned to a different link 32 of the chain 30 wherein the succeeding link is captured in indention 24 and the chain 30 is again pulled another distance. By repeating this process, the chain 30 can be easily and quickly pulled a great distance. When the chain 30 has been pulled the correct distance, the tool 10 is removed from the chain by passing the chain link 32 through slot 20 to the outside of the tool.

Figure 5:
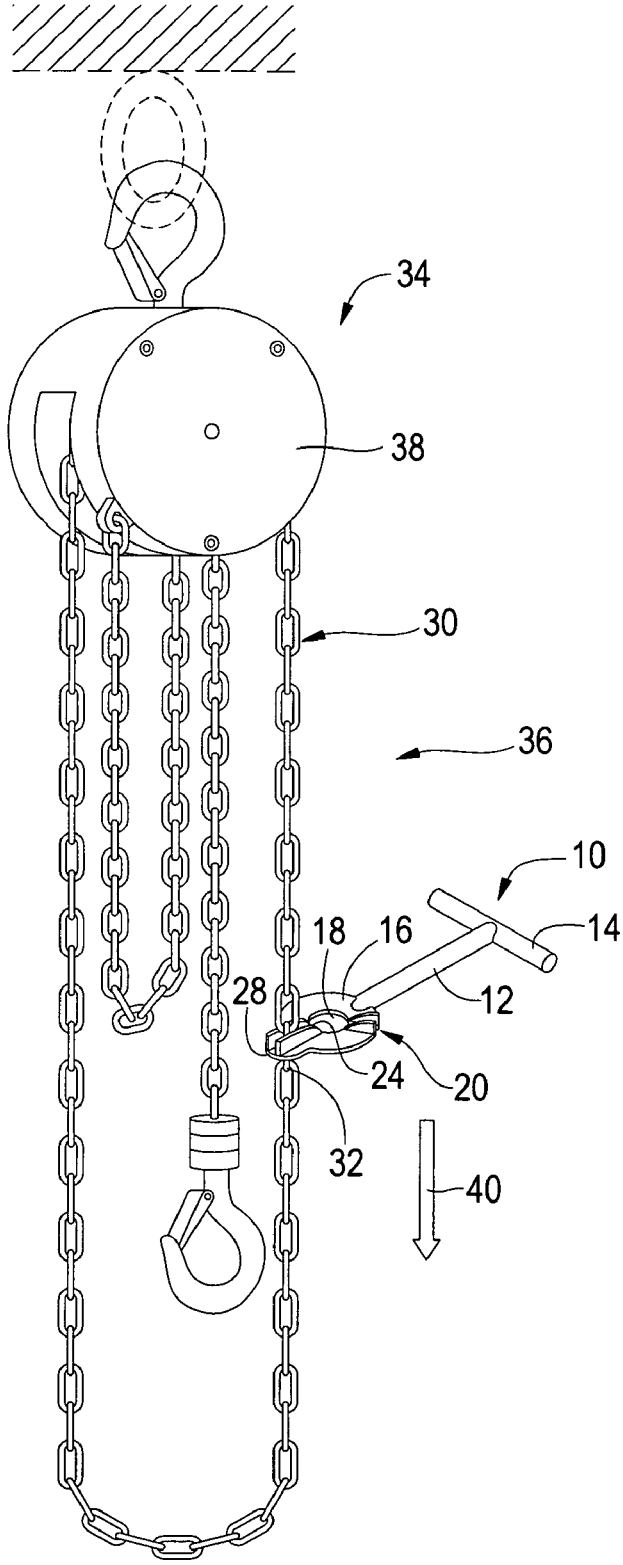
FIG. 5 is a perspective view of the present invention shown in operative connection with a chain hoist.

Turning to FIG. 5, therein is shown the present invention 10 having a shaft 12 and a handle 14 on one end and a ring 16 on the other end in operative connection with a conventional chain hoist 34 having a chain portion 36 and a block portion 38. Ring 16 has a hole 18 in the center thereof along with a first inlet/outlet slot or cut-through 20 having first and second upwardly extending protrusions on each side along with a second indention 24 having first and second upwardly extending protrusions on each side along with a portion 28 which is uncut. In operation, a chain link 32 can be inserted through slot 20 into a central hole 18 of the ring 16, then, the user slides the tool 10 up to a user selected chain link 32 and the link is moved from the hole into indention/receptacle 24 so that the first link of the chain is captured in indention 24 thereby allowing the user to pull on the handle downwardly so as to move the chain 30 a given distance as indicated by direction arrow 40. Thereafter, the chain link 32 is removed from indention 24 into the center hole 18 and the tool repositioned to a different user selected succeeding link 32 of the chain 30 wherein the succeeding link is captured in indention 24 and the chain is again pulled another distance. By repeating this process, the chain 30 can be pulled a great distance. When the chain 36 has been pulled the correct distance, the tool 10 is removed from the chain by passing the chain link 32 through slot 20 to the outside of the tool.

We claim:

1. A hand tool for gripping a chain, comprising:

a) a handle for being grasped in a hand of a user;

b) a body disposed on said handle, said body having a hole therein;

c) said body having a slot therein, wherein said slot extends entirely through said body to said hole to permit the chain to pass through said slot from a first point outside said body to a second point inside said hole of said body;

d) an indention disposed in said body, wherein said indention is configured for capturing the chain link therein; and e) outwardly extending first and second protrusions disposed on first and second sides of said slot.

2. The apparatus of claim 1, further comprising a third and fourth protrusion disposed on a first and second side of said indention.

3. The apparatus of claim 1, wherein said first and second protrusions are effectively sized to allow the chain to pass therethrough.

4. The apparatus of claim 3, wherein said third and fourth protrusions are effectively sized to capture the chain.

5. The apparatus of claim 1, wherein said slot is effectively sized to allow the chain to pass therethrough, wherein said indention is effectively sized to capture the chain.

6. The apparatus of claim 1, wherein said body is shaped as a ring.

7. A method of making a hand tool for gripping a chain, comprising the steps of:

a) providing a handle for being grasped in a hand of a user;

b) providing a body on the handle, the body having a hole therein;

c) providing a slot in the body, wherein the slot extends entirely through the body to permit the chain to pass through the slot from a first point outside the body to a second point inside the hole of the body;

d) providing an indention in the body, wherein the indention is configured for capturing the chain; and e) providing first and second protrusions on first second sides of the slot.

8. The method of claim 7, further comprising the step of providing a third and fourth protrusion on a first and second side of the indention.

9. The method of claim 7, wherein the first and second protrusions are effectively sized to allow the chain to pass therethrough.

10. The method of claim 9, wherein the indention and third and fourth protrusions are effectively sized to capture the chain.

11. The method of claim 7, wherein the slot is effectively sized to allow the chain to pass therethrough, wherein the indention is effectively sized to capture the chain.

12. The method of claim 8, wherein the body is shaped as a ring.

13. The method of using a hand tool for gripping a chain, comprising the steps of:

a) a user grasping a handle of the hand tool, the hand tool comprising a body on the handle, the body having a hole therein large enough to accommodate said chain, a slot provided in the body, wherein the slot extends entirely through the body to said hole to permit the chain to pass through the slot into said hole, an indention provided in a surface of said body surrounding said hole and spaced from said slot and having a length and width large enough to accommodate said chain but extending only partway through said body and having outwardly extending protrusions on sides of said indention, the height of said protrusions being slightly less than the distance between succeeding links of said chain;

b) the user selecting a first link of the chain intermediate ends of said chain, the user passing the first link through the slot into the hole in the body;

c) the user inserting the first link into the indentation so that the first link is captured in the indentation, said indention and protrusions being effectively sized to capture a chain link therein;

d) the user pulling the chain a user selected distance;

e) the user removing the first link from the indention so that the chain is disposed in the hole, the user then selecting a second link of the chain and repositioning the second user selected link in the indention and pulling the chain a user selected distance, the user repeating steps a) to e) a user selected number of times; and, f) the user removing the hand tool from the chain by moving the link from the indentation into the hole inside the body and then passing the link through the slot to the outside of the body.

14. A hand tool for gripping a chain, comprising:

a) a handle for being grasped in a hand of a user;

b) a body disposed on said handle, said body having a hole therein large enough to accommodate said chain;

c) said body having a slot therein, wherein said slot extends entirely through said body to said hole to permit the chain to pass through said slot into said hole;

d) an indention disposed in a surface surrounding said hole of said body spaced from said slot, said indentation extending a length which is partway through said body but longer than a width of said chain; and e) outwardly extending protrusions on each side of said indention, said indention and protrusions being effectively sized to capture a chain link therein.

15. The hand tool of claim 14 in which said indention has an uncut portion shaped to help capture a chain link.

16. The hand tool of claim 14 in which the height of said protrusions is slightly less than the distance between succeeding links of said chain.

* * * * *